US005456226A

United States Patent [19]

Doll

[11] Patent Number: 5,456,226

[45] Date of Patent: Oct. 10, 1995

[54] METHOD OF MINIMIZING PLAY IN A VALVE OPERATING MECHANISM

[75] Inventor: Gerhard Doll, Esslingen, Germany

[73] Assignee: Mercedes Benz AG, Stuttgart, Germany

[21] Appl. No.: 378,567

[22] Filed: Jan. 26, 1995

[30] Foreign Application Priority Data

Feb. 15, 1994 [DE] Germany ..... 44 04 683.9

[51] Int. Cl.[6] ..... F01L 1/20; F01L 1/04

[52] U.S. Cl. ..... 123/90.16; 123/90.45

[58] Field of Search ..... 123/90.15, 90.16, 123/90.17, 90.39, 90.41, 90.42, 90.44, 90.45

[56] References Cited

U.S. PATENT DOCUMENTS

| | | | |
|---|---|---|---|
| 4,848,285 | 7/1989 | Konno | 123/90.16 |
| 5,095,859 | 3/1992 | Iwata et al. | 123/90.16 |
| 5,297,505 | 3/1994 | Doll et al. | 123/90.16 |
| 5,297,506 | 3/1994 | Reckzügel et al. | 123/90.16 |

FOREIGN PATENT DOCUMENTS

| | | |
|---|---|---|
| 0267687 | 1/1992 | European Pat. Off. . |
| 2196694 | 5/1988 | United Kingdom . |

*Primary Examiner*—Henry C. Yuen

*Assistant Examiner*—Weilun Lo

*Attorney, Agent, or Firm*—Klaus J. Bach

[57] ABSTRACT

In a method of minimizing the play in a valve operating mechanism having first and second valve operating rocker arms mounted side-by-side on a support shaft wherein each rocker arm has one end disposed on a cam of a cam shaft to be actuated thereby and, the first rocker arm has its opposite end disposed on a gas-change valve for operating the valve while the second rocker arm has at its opposite end a coupling bore disposed adjacent a coupling bore formed in the first rocker arm and a coupling pin is arranged in the coupling bore of one of the rocker arms and projects into the bore of the other for engagement of the rocker arms with one another, the two rocker arms are mounted in a coupled state on the shaft of a measuring arrangement, a force is then applied to the valve engaging end of the first rocker arm for firmly biasing the first rocker arm against a base circle location of its associated cam and a force is applied to the one end of the second rocker arm to force it away from its associated cam into firm engagement with the first rocker arm via the coupling pin and a support roller with a diameter essentially twice the distance between a support roller axis on the second rocker arm and the associated cam base circle surface is then selected for installation in the second rocker arm.

2 Claims, 2 Drawing Sheets

METHOD OF MINIMIZING PLAY IN A VALVE OPERATING MECHANISM

BACKGROUND OF THE INVENTION

The invention relates to a method of minimizing play in a valve operating mechanism of an internal combustion engine.

European Patent 267 687 discloses a valve operating mechanism for an internal combustion engine, wherein an inlet valve is actuated, depending on the instantaneous speed of the internal combustion engine, via a low-speed cam or a high-speed cam. To this end, two adjacently arranged valve-actuating levers are mounted on a common shaft and are kinematically coupled to one another via a coupling pin when the actuation of the inlet valve is to be effected via the high-speed cam. In the case of kinematic coupling of the two valve-actuating levers, the coupling pin projects into both a coupling bore arranged in the one valve-actuating lever and a coupling bore arranged in the other valve-actuating lever. Due to manufacturing tolerances for the cam shaft, the valve-actuating levers, their bearing spindles, the coupling pin and the coupling bores accommodating the latter, a relatively large play can develop at the coupling-pin location between the two valve-actuating levers. Such play has an adverse effect on the character of the valve-lift curve as well as on the inlet and exhaust valve overlap and thus on the volumetric efficiency of the internal combustion engine as well as on its idling residual-gas behavior. The consequence thereof is poor idling and poor performance.

It is the object of the present invention to provide a method by which these disadvantages can be reduced to a minimum.

SUMMARY OF THE INVENTION

In a method of minimizing the play in a valve operating mechanism having first and second valve operating rocker arms mounted side-by-side on a support shaft wherein each rocker arm has one end disposed on a cam of a cam shaft to be actuated thereby and, the first rocker arm has its opposite end disposed on a gas-change valve for operating the valve while the second rocker arm has at its opposite end a coupling bore disposed adjacent a coupling bore formed in the first rocker arm and a coupling pin is arranged in the coupling bore of one of the rocker arms and projects into the bore of the other for engagement of the rocker arms with one another, the two rocker arms are mounted in a coupled state on the shaft of a measuring arrangement, a force is then applied to the valve engaging end of the first rocker arm for firmly biasing the first rocker arm against a base circle location of its associated cam and a force is applied to the one end of the second rocker arm to force it away from its associated cam into firm engagement with the first rocker arm via the coupling pin and a support roller with a diameter essentially twice the distance between a support roller axis on the second rocker arm and the associated cam base circle surface is then selected for installation in the second rocker arm.

The method according to the invention insures that, by firmly engaging the first rocker arm with the base circle of an accurately dimensioned cam, first any play of the first rocker arm—caused by production tolerances on the rocker arm bearing spindle, on the spindle bore of the first rocker arm and possibly by tolerances of a support roller rotatably mounted on the rocker arm and interacting with the cam-is eliminated. By the subsequent application of a force in the lifting direction to the support roller side of the second rocker arm, as a result of which the second rocker arm is supported via the coupling pin against the first rocker arm which is already engaged so as to be free of play, any play still present in the area of the coupling pin is eliminated. As a result of these measures, there is now a very definite distance between the base circle of an accurately dimensioned cam surface associated with the second rocker arm and the axis of rotation of the support roller of the second rocker arm. All play which has been removed from the individual bearing and supporting points by the mutual engagement of both rocker arms is included in this distance. If then a support roller is selected which has a size corresponding to this distance and is assigned for installation with the second valve-actuating lever, any play is eliminated from the entire arrangement. If the support roller is selected with a slight nominal play the coupling pin can be engaged easily and reliably. Furthermore, tolerances which cannot be eliminated can be compensated for by this measure. If this arrangement is installed into an internal combustion engine with precisely the selected support roller, any remaining play is reduced to a minimum.

The invention is described in greater detail in the drawings with reference to an exemplary embodiment.

DESCRIPTION OF A PREFERRED EMBODIMENT

Figure 1:
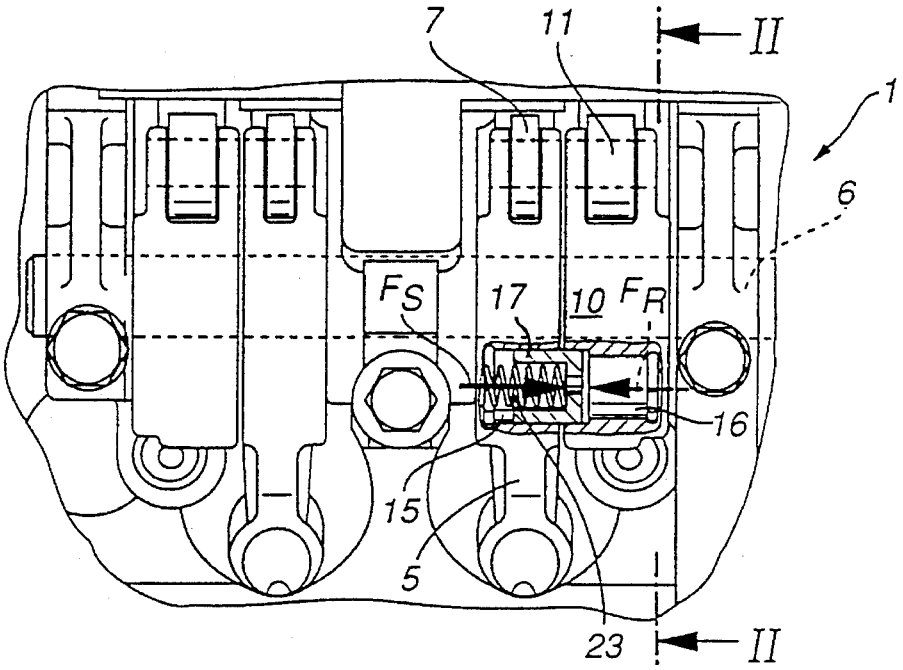
FIG. 1 shows a valve drive arrangement of an internal combustion engine in plan view.
Figure 2:
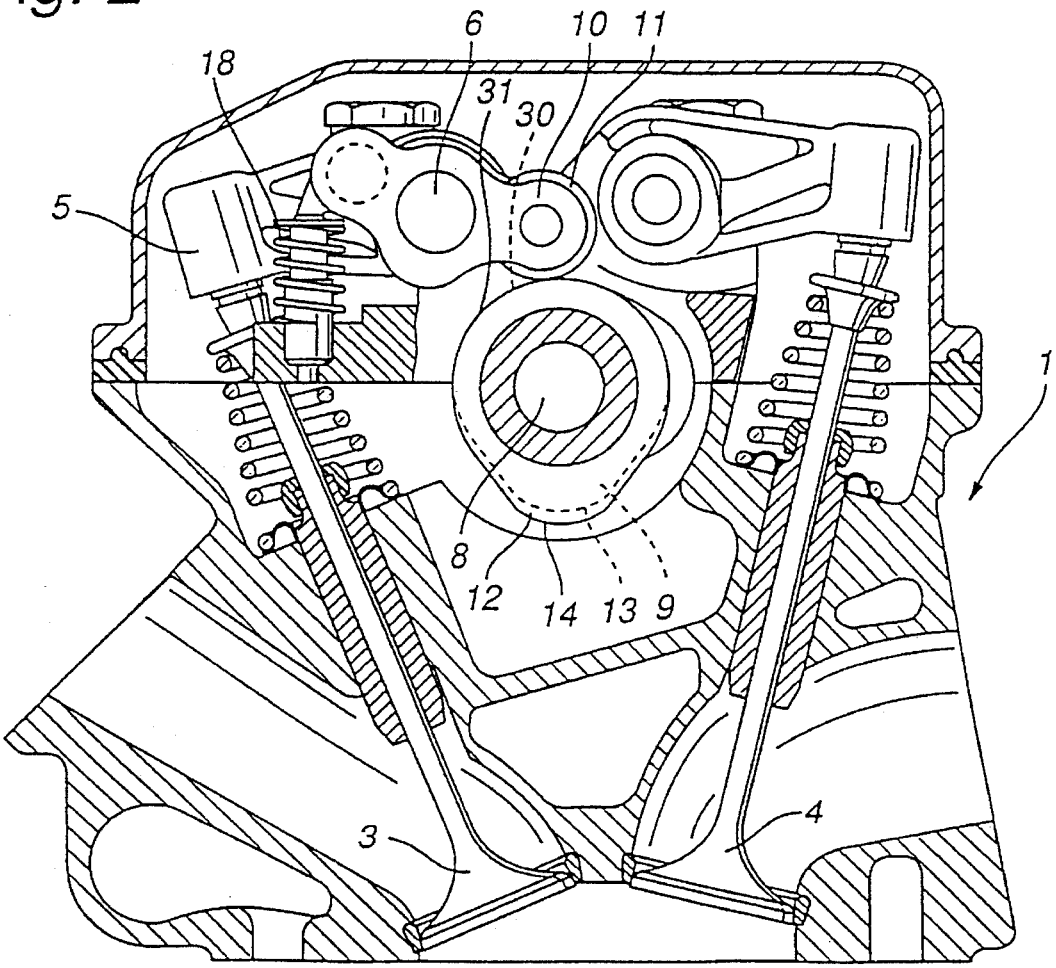
FIG. 2 is a cross-sectional representation taken along line II—II of FIG. 1.

FIGS. 1 and 2 show a valve operating mechanism arranged in the cylinder head 1 of an internal combustion engine, for actuating the inlet valves 3 and outlet valves 4 controlling the gas change of the internal combustion engine. Here, the inlet valves 3 are actuated via a first rocker arm 5 (primary rocker arm) which is pivotally mounted on a shaft 6 and is operated via a support roller 7 by a first cam 9 arranged on a cam shaft 8. A further rocker arm 10 (second rocker arm) is pivotally mounted on the shaft 6 directly adjacent the primary rocker arm 5 and is actuated via a further support roller 11 by an additional cam 12 of the cam shaft 8. In this arrangement, the envelope curve 13 of the cam 9 actuating the primary rocker arm 5 lies inside the curve 14 of the second cam 12 actuating the secondary rocker arm 10. On their sides facing one another, both valve-actuating rocker arms 5 and 10 each have a coupling bore 15 and 16 respectively, which are in alignment when the support rollers 7 and 11 of both rocker arms 5 and 10 are disposed on the base circle 30 and 31 respectively of the associated cams 9 and 12 respectively. During this period, a coupling pin 17 arranged in the coupling bore 15 of the primary rocker arm 5 can be axially displaced, when required by application of an adjusting force $F_S$ (here by the spring 23) acting in the axial direction in such a way that the pin 17 extends into both the coupling bore 15 of the primary rocker arm 5 and the coupling bore 16 of the secondary rocker arm 10 (position as shown in FIG. 1), as a result of which the two rocker arms 5 and 10 are kinematically coupled to one another. In this case, the inlet valve 3 is actuated in accordance with a valve-lift curve predetermined by the envelope curve 14 of the second cam 12. On the other hand, if the coupling pin 17 is completely pressed back into the coupling bore 15 of the primary rocker arm 5 by a restoring force $F_R$, the two rocker arms 5 and 10 are uncoupled from one another so that the inlet valve 3 is actuated in accordance with a valve-lift curve predetermined by the envelope curve 13 of the first cam 9. (The restoring force $F_R$ can be produced, for example, via a restoring piston, which is acted upon hydraulically and is guided in the coupling bore 16 but is not explicitly shown in the drawing.) The envelope curve of the cam actuating the primary rocker arm 5 can, of course, also remain restricted to that of the base circle so that, in the case of kinematic uncoupling of the primary rocker arm and the secondary rocker arm, the inlet valve 3 remains in its closed position over the entire cam shaft rotation. In this case, an identical arrangement can also be provided for controlling the exhaust valves (predetermined cylinder shut down).

In order to prevent uncontrolled lifting of the support roller 11 of the secondary rocker arm 10 from the camming surface when the rocker arms 5 and 10 are uncoupled, the secondary rocker arm 10 is held in engagement with the associated cam by a spring element 18 provided on its side opposite the support roller 11.

Figure 3:
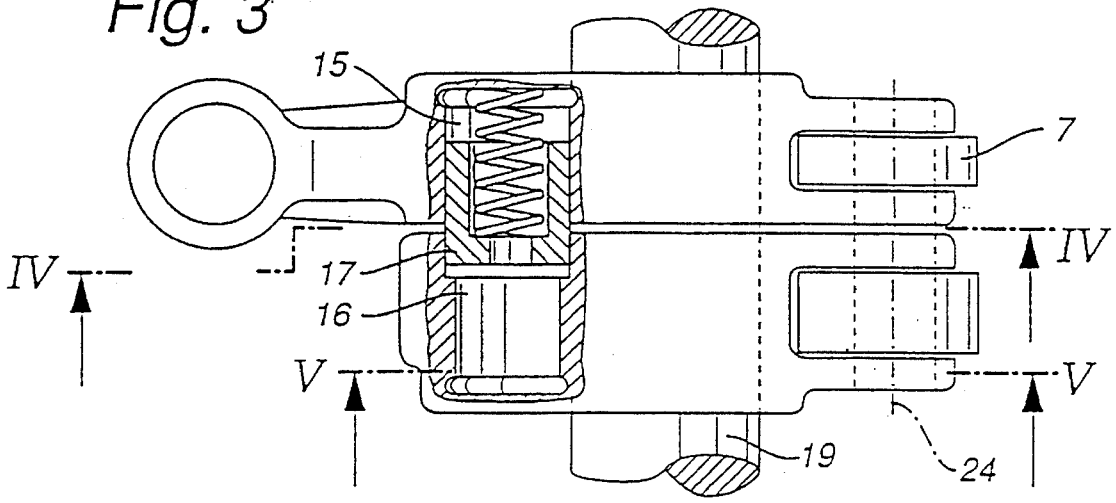
FIG. 3 shows a two rocker arms associated with an inlet valve, kinematically coupled to one another by means of the coupling pin and arranged in a measuring device.
Figure 4:
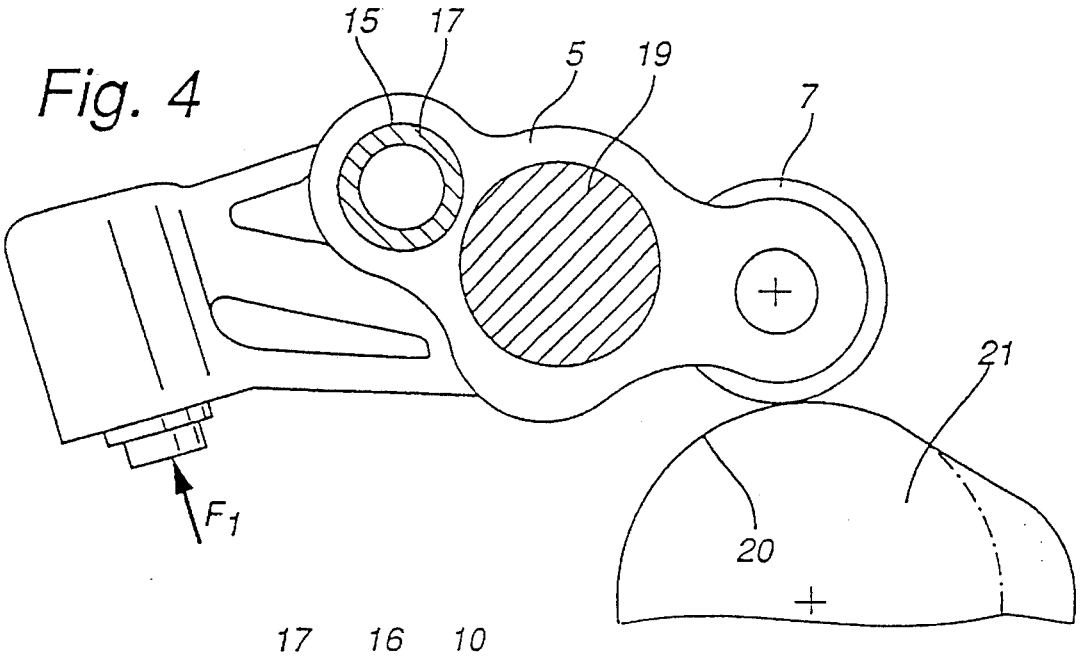
FIG. 4 is a cross-sectional representation taken along line IV—IV of FIG. 3.
Figure 5:
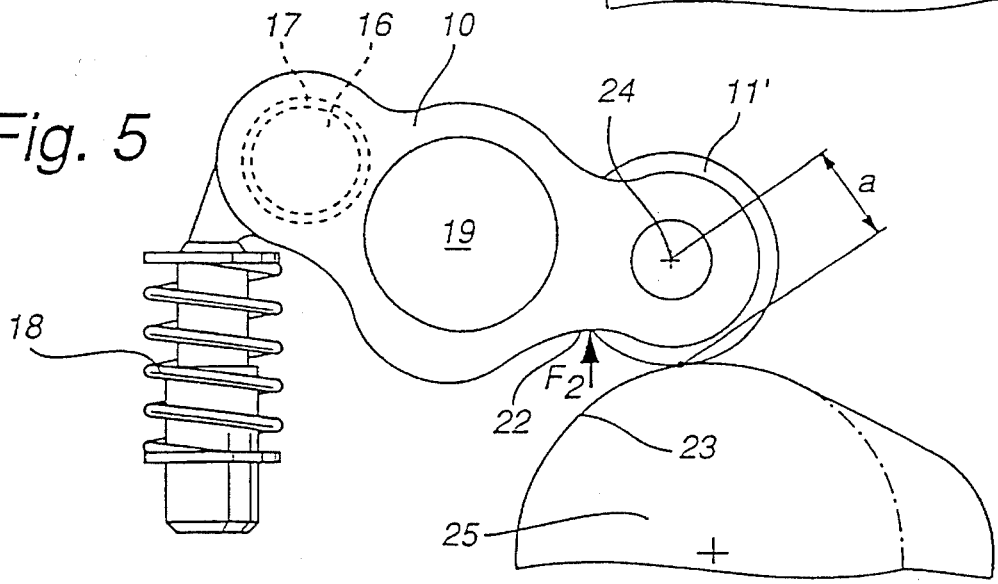
FIG. 5 is a cross-sectional representation taken along line V—V of FIG. 3.

According to the invention, both rocker arms 5 and 10 are mounted in the coupled state on a common shaft 19 of a measuring device (not shown in the drawing) before the valve drive arrangement is fitted into the cylinder head 1 (see FIG. 3), the primary rocker arm 5 already being provided with the support roller 7 but no support roller being mounted on the secondary rocker arm 10. The common shaft 19 may also be the same support shaft 6 on which the two rocker arms 5 and 10 are mounted when they are installed in the cylinder head 1. In the next step, a small force $F_1$ acting in the valve closing direction is applied to the valve-side end of the primary rocker arm 5, by which force $F_1$ the primary rocker arm 5 is biased against the base circle 20 of a properly sized cam 21 of the measuring device so that all play caused by production tolerances in the various support points is accommodated (see FIG. 4). For this procedure the force $F_1$ is selected in such a way that all play is eliminated, but there is no significant elastic deformation of the individual components. A further force $F_2$ acting in the lifting direction is then applied to the underside 22 of the support roller-side end of the secondary rocker arm 10 (see FIG. 5). Since the two valve-actuating rocker arms 5 and 10 are kinematically coupled to one another via the coupling pin 17, the secondary lever 10, as a result of the force $F_2$, is then supported via the coupling pin 17 on the already restrained primary rocker arm 5. This in turn eliminates all play present in the area of the coupling pin 17 between the primary rocker arm and the secondary rocker arm (play between coupling pin 17 and coupling bores 15 and 16, respectively). The force $F_2$ is selected in such a way that all play is removed, but there is no significant deformation of any component and that it is insufficient to overcome force $F_1$. After the force $F_2$ is applied, a certain distance "a" appears between the base circle 23 of another correctly sized cam 25, allocated to the secondary rocker arm 10, and the rotational axis 24 of the support roller on the secondary rocker arm 10, in which distance "a" any play eliminated by the forces $F_1$ and $F_2$ on the two rocker arms 5 and 10 in particular in the coupling-pin area is included. A support roller 11' having a radius essentially corresponding to this distance "a" is now assigned to and installed in the secondary rocker arm 10, i.e., a support roller 11' which has a diameter of twice the distance "a" less a slight, exactly defined nominal play to guarantee reliable engaging of the coupling pin 17 and to compensate for tolerances which cannot be eliminated. With this assigned support roller 11' for the secondary rocker arm 10, the complete arrangement of primary rocker arm 5, support roller 7, coupling pin 17 and secondary rocker arm 10 is fitted into the cylinder head 1 of the internal combustion engine.

This operation is repeated for each pair of primary rocker arms and secondary rocker arms allocated to an inlet valve.

The primary rocker arm need not necessarily interact with the cam via a support roller; it can also be operated in a conventional manner by sliding on the surface of an associated cam.

What is claimed is:

1. A method of minimizing the play in a valve operating mechanism comprising a first valve operating rocker arm pivotally mounted on a support shaft and having one end disposed on a cam of a cam shaft and the opposite end on a gas-change valve for operating said valve, a second rocker arm pivotally mounted on said support shaft adjacent said first rocker arm and having one end disposed on another cam of said cam shaft and having at its opposite end a coupling bore disposed adjacent a coupling bore formed in said first rocker arm, said coupling bores being in axial alignment when the one end of each rocker arm is engaged by a base circle surface of each associated cam, and a coupling pin arranged in the coupling bore of one of said rocker arms and being adapted to be moved to project into the coupling bore of the other rocker arm when said coupling bores are in alignment for kinematic engagement of the rocker arms with one another, and at least said second rocker arm having a support roller disposed at its one end for its engagement with the associated cam of said cam shaft, said method comprising the steps of:

mounting the two rocker arms in a coupled state on a shaft in a measuring arrangement, applying a force to said opposite end of said first rocker arm for firmly biasing said one end of said first rocker arm against the base circle location of an accurately sized cam, applying a force to said one end of said second rocker arm in a direction away from its associated cam surface for firmly biasing the other end of said second rocker arm into engagement with said first rocker arm via said coupling pin engaging the two rocker arms, determining the distance "a" between the associated cam surface and the rotational axis of said support roller on said second rocker arm and selecting a corresponding support roller with a diameter of essentially "2 a" for installation with said second rocker arm.

2. A method according to claim 1, wherein said support roller is selected so as to provide for an exactly predetermined nominal play.

* * * * *